US005181840A

United States Patent [19]

Zecchini

[11] Patent Number: 5,181,840

[45] Date of Patent: Jan. 26, 1993

[54] ENGINE COMPRESSOR WITH A PERFECTED VENTILATING DEVICE

[75] Inventor: Franco Zecchini, via Anna Frank, Italy

[73] Assignee: Fini Electtrocostruzioni Meccaniche S.p.A., Fratelli Rosselli, Italy

[21] Appl. No.: 654,759

[22] Filed: Feb. 13, 1991

[30] Foreign Application Priority Data

Feb. 28, 1990 [IT] Italy ..... 4739 B/90

[51] Int. Cl.[5] ..... F04B 17/00

[52] U.S. Cl. ..... 417/364; 417/366; 417/373; 415/175

[58] Field of Search ..... 417/364, 366, 373, 380; 415/175, 177

[56] References Cited

U.S. PATENT DOCUMENTS 3,467,014 9/1969 Keyes et al. ..... 417/373
4,648,806 3/1987 Alexander ..... 417/364
5,035,586 7/1991 Sadler et al. ..... 417/364

FOREIGN PATENT DOCUMENTS 965939 8/1964 United Kingdom ..... 417/373

*Primary Examiner*—Richard A. Bertsch
*Assistant Examiner*—Charles Freay
*Attorney, Agent, or Firm*—Ladas & Parry

[57] ABSTRACT

An engine compressor comprising an internal combustion engine with a drive shaft; a compressor with a head and a cylinder; and a device for ventilating the head and cylinder, and having: an impeller fitted on to the drive shaft; a housing mounted between the casings of the engine and the compressor, and defining an internal chamber housing the impeller; an inlet formed in a central position of the housing and through which ambient air is drawn; and an outlet formed in the top portion of the housing and through which air is fed to the head and the cylinder.

9 Claims, 4 Drawing Sheets

ENGINE COMPRESSOR WITH A PERFECTED VENTILATING DEVICE

BACKGROUND OF THE INVENTION

The present invention relates to an engine compressor with a perfected ventilating device.

Compressors are motor-driven devices which are currently powered by electric motors. As such, operation of the compressor depends on the possibility of connecting the motor to an electricity supply means. If this is not available, the compressor is connected to an internal combustion engine with a fuel tank, to produce an independently-operating engine compressor. Unfortunately, engine compressors are currently used on a very limited scale, due to difficulties in providing for effective ventilation of the compressor. On those currently available on the market, the compressor is ventilated by feeding the engine cooling air over the head of the compressor. Given an output engine cooling air temperature of 120°-150° C. and a temperature of 150°-200° C. on the head of the compressor, this is obviously poorly ventilated, and can only be operated at maximum load for limited periods of time, to avoid subjecting the components, e.g. the valves, on the head of the compressor to severe thermal stress resulting in wear and impaired performance.

SUMMARY OF THE INVENTION

The aim of the present invention is to provide an engine compressor with a perfected ventilating device, designed to substantially reduce thermal wear of the compressor and so enable long-term maximum-load operation of the same.

Further aims and advantages of the present invention will be revealed in the following description.

With this aim in view, according to the present invention, there is provided an engine compressor comprising an internal combustion engine with a drive shaft; and a compressor having a head and a cylinder inside which operates a piston fitted to a connecting rod mechanically connected to said drive shaft; characterised by the fact that it comprises a device for ventilating said head and said cylinder, and having:

a centrifugal impeller fitted on to said drive shaft upstream from the point at which said drive shaft is connected to said connecting rod;

a housing installed between the casing of said engine and the casing of said compressor, fitted through with said drive shaft, and defining an internal ventilating chamber housing said impeller;

an inlet formed in a central portion of said housing and through which ambient air is drawn into said chamber; and an outlet formed in the top portion of said housing and through which air is fed to said head and said cylinder.

BRIEF DESCRIPTION OF THE DRAWING

A preferred, non-limiting embodiment of the present invention will be described by way of example with reference to the accompanying drawings, in which.

DETAILED DESCRIPTION OF THE INVENTION

Figure 1:
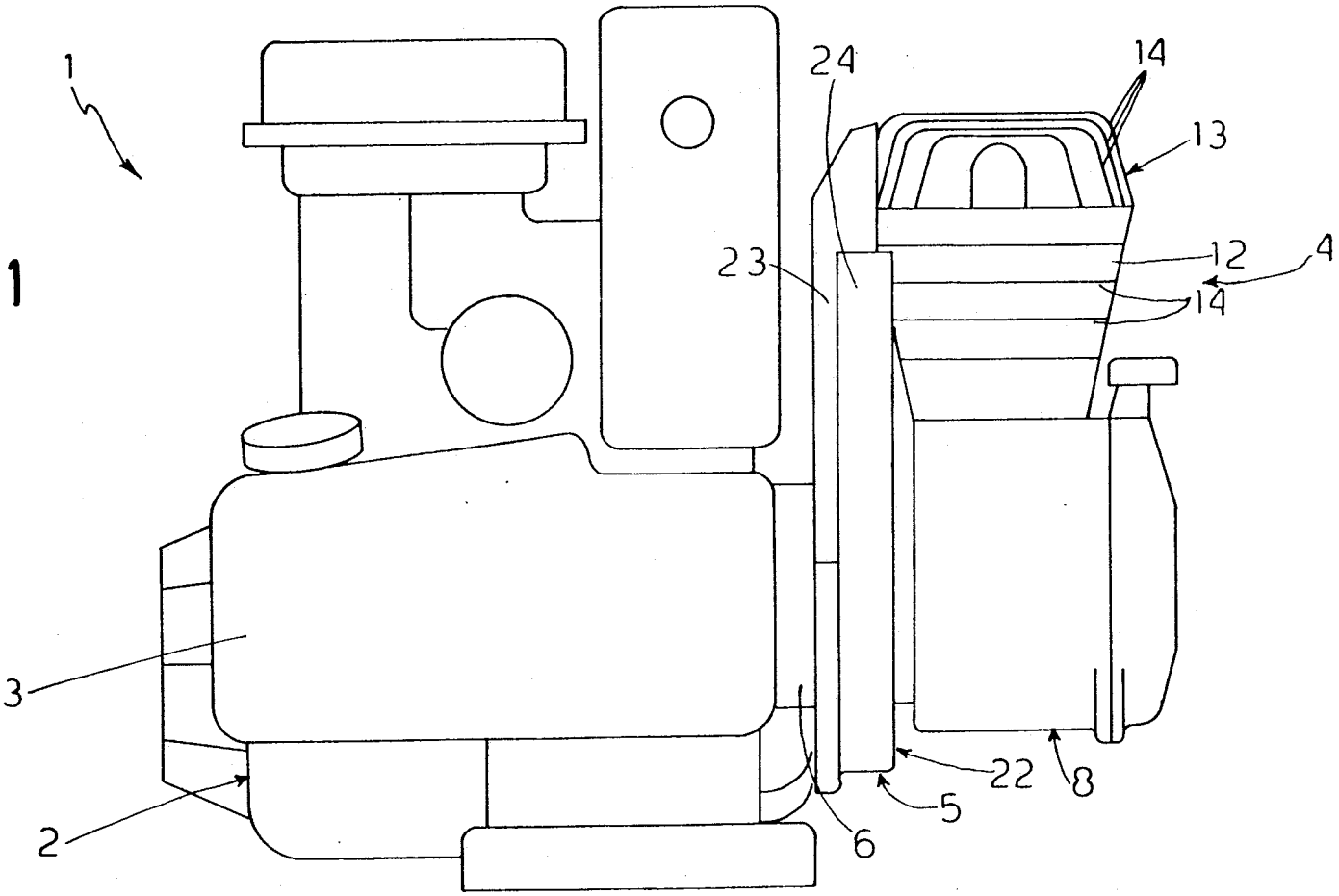
FIG. 1 shows an external view of an engine compressor.

Number 1 in FIG. 1 indicates an engine compressor comprising: an internal combustion engine 2 having an internal ventilating system (not shown) and a fuel tank 3; a compressor 4; and a device 5 for force-ventilating compressor 4 independently of the cooling system on engine 2. Device 5 is installed between engine 2 and compressor 4, and is so designed as to require no alteration of engine 2 or compressor 4, which may be of the type currently available on the market.

A brief description of engine 2 and compressor 4, which are known types, will be given with reference to FIG. 2. Engine 2 comprises a casing 6 from which extends a drive shaft 7. Compressor 4 comprises a casing 8 inside which power is transmitted between shaft 7 and a connecting rod 11; a cylinder 12 mounted over casing 8 and inside which operates a piston (not shown) fitted to connecting rod 11; and a head 13 with valves and an inlet and outlet for the fluid compressed by the piston. Cylinder 12 and head 13 present cooling fins 14, those on cylinder 12 increasing in size towards head 13. Power is transmitted between shaft 7 and connecting rod 11 by a crankshaft 15 having a coupling 16 engaged internally and eccentrically by the end of shaft 7. Casing 8 presents a wall 17 facing the surface of casing 6 from which extends shaft 7, the central portion of which presents a through hole engaged by a cylindrical coupling 18 inside which coupling 16 of crankshaft 15 rotates via a roller bearing 21.

Figure 2:
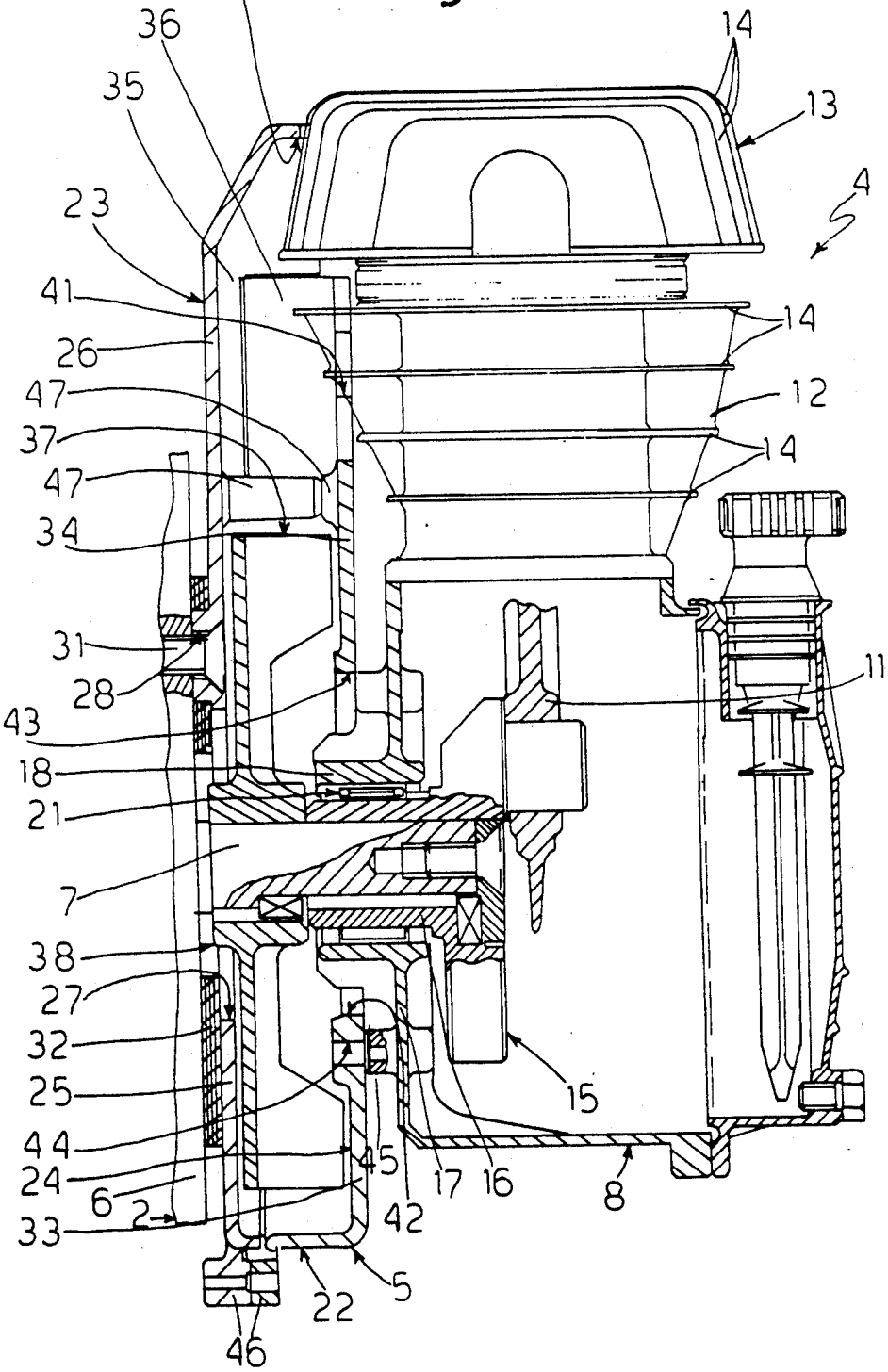
FIG. 2 shows a partially-sectioned, larger-scale view of a device for ventilating the compressor on the FIG. 1 engine compressor.
Figure 3:
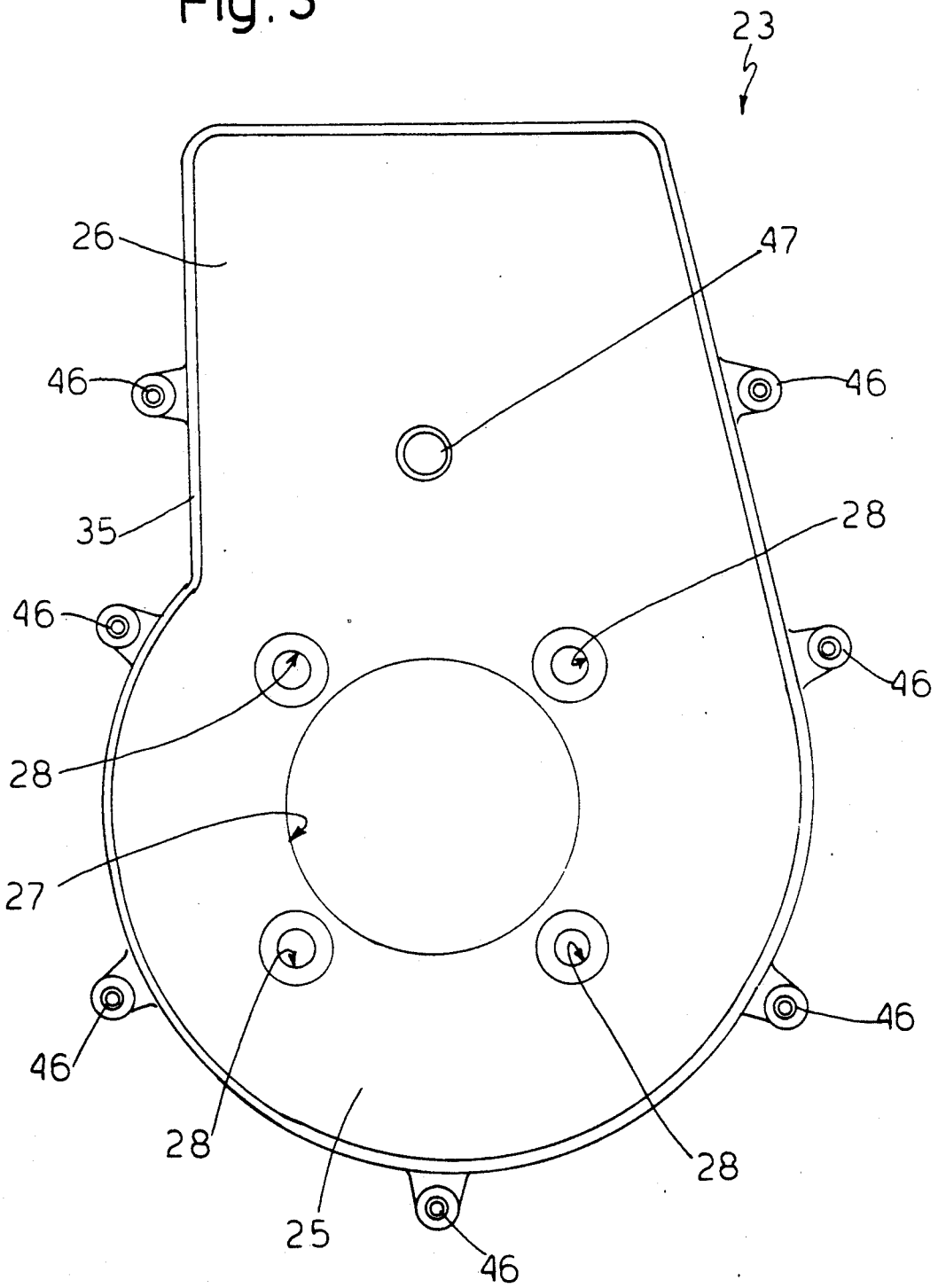
FIGS. 3 and 4 show views of two parts of the FIG. 2 device.

As shown in FIG. 2, device 5 comprises a housing 22 consisting of two plates 23 and 24, plate 23 being secured parallel to the face of casing 6 from which shaft 7 extends, and plate 24 being secured parallel to wall 17 of casing 8 on compressor 4. As shown also in FIG. 3, plate 23 presents a semicircular bottom portion 25 coaxial with shaft 7, and a substantially rectangular top portion 26 in the same plane as portion 25 and extending upwards to head 13. In particular, the top end portion of portion 26 is bent obliquely towards head 13. The central portion of portion 25 presents a through hole 27 fitted though coaxially with the shaft 7. Around hole 27, there are formed a number of small through holes 28 engaged by screws 31 for securing plate 23 to casing 6. Between said surface of casing 6 and plate 23, casing 6 is fitted with a layer of thermal insulating material (preferably thermoplastic or heat-setting) for the reasons described later on.

Like plate 23, plate 24 (FIGS. 2 and 4) presents a semicircular bottom portion 33 coaxial with shaft 7, and a substantially rectangular top portion 34 in the same plane as portion 33 and extending upwards to the top end of cylinder 12 and therefore just beneath head 13. Apart from the top edge, plates 23 and 24 present respective edges 35 and 36 bent towards each other so as to form, between plates 23 and 24, a ventilation chamber 37 housing a centrifugal fan 38 fitted on to shaft 7. Chamber 37 presents an outlet 39 defined between the top edges of plates 23 and 24, and facing and therefore supplying air towards head 13. The top edge of plate 24 presents a number of central slots 41 facing and therefore forming part of outlet 39. Said slots 41 are formed at fins 14 of cylinder 12, and provide, not only for ventilating cylinder 12, but also for extending some of fins 14 inside chamber 37.

Figure 4:
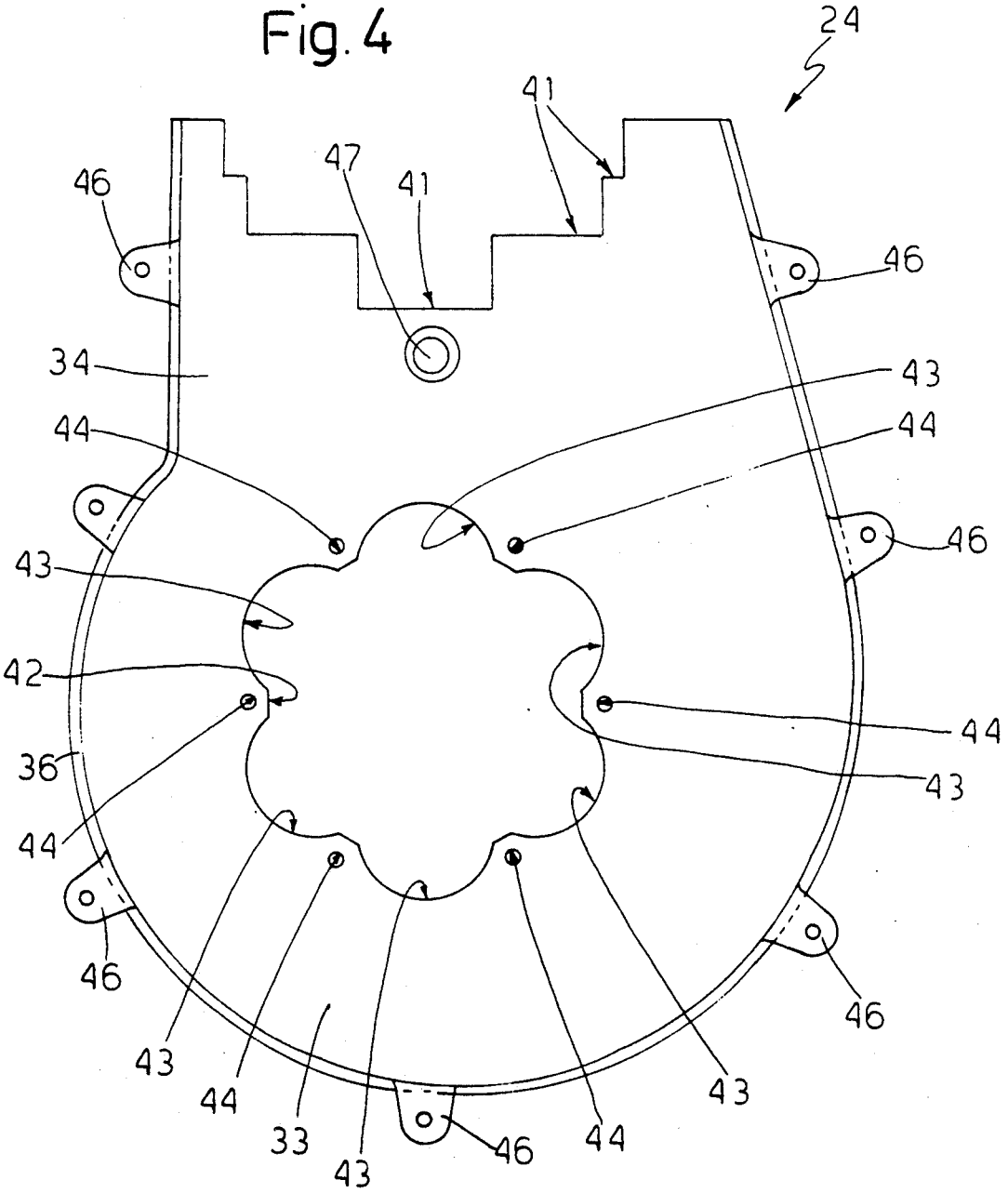

As shown in FIGS. 2 and 4, the central portion of portion 33 presents a through hole 42 fitted through coaxially with shaft 7 and at which bearing 21 is located. The edge of hole 42 presents a number of lobes 43 through which ambient air is drawn into chamber 37. About hole 42 and between lobes 43, there are formed a number of small through holes 44 engaged by respective screws (not shown) securing plate 24 to wall 17. Between plate 24 and wall 17, a predetermined clearance is defined by spacer cylinders 45 which, in addition to defining a passage for said ambient air, also provide for seating said assembly screw. The respective edges of plates 23 and 24 present a number of tabs 46 secured firmly by means of screws not shown. Finally, between portions 26 and 34, for defining a predetermined clearance between the same, there are fitted two coaxial, contacting cylinders 47, one extending from portion 26 and the other from portion 34. Impeller 38 is located at bottom portions 25 and 33 and, needless to say, is driven by shaft 7. As already stated, impeller 38 is a centrifugal type, which therefore draws in ambient air from the center of chamber 37 (hole 42 and lobes 43) and feeds it to the top portion of housing 22, where it is fed by outlet 39 on to head 13 and the top portion of cylinder 12. Laboratory tests conducted by the Applicant have shown a reduction of approximately 40° C. in the maximum temperature of compressor 4.

The advantages of the present invention will be clear from the foregoing description.

In particular, it provides for effective, independent ventilation of the compressor, thus enabling prolonged, maximum-load operation of the engine compressor which, as stated, may be operated independently in any location. It should be stressed that, in addition to being cheap and easy to produce, the compressor ventilating device requires no particular alterations to the engine or the compressor, which may thus be commercial type currently available on the market. Another point to note is that the compressor is thermally insulated from the engine by the layer of material between the housing of the ventilating device and the engine casing. Moreover, whereas normally the engine cooling air comes out over the head of the compressor, according to the present invention, said air, which is practically as hot as the compressor and therefore ineffective in terms of ventilation, is deflected upwards by virtue of the external design and size of the housing. Moreover, all the rotary parts on the compressor and the impeller of the ventilating device are mounted on the drive shaft with no alternations required, by virtue of the drive function being performed by keys (FIG. 2) fitted inside recesses already provided on standard shafts. Finally, provision of the roller bearing enables the drive shaft to withstand severe flexural stress.

To those skilled in the art it will be clear that changes may be made to engine compressor 1 as described and illustrated herein without, however, departing from the scope of the present invention.

I claim:

1. An engine compressor comprising:

an internal combustion engine having a drive shaft extending therefrom;

a compressor portion having a head and a cylinder inside of which a piston is located, the piston being attached to a connecting rod which is mechanically connected to said drive shaft so that the piston can be moved; and a device for ventilating said head and said cylinder which includes a centrifugal impeller fitted on to said drive shaft located between the engine and the point at which said drive shaft is connected to said connecting rod, a housing installed between a casing of said engine and a casing of said compressor portion, said housing defining an internal ventilating chamber housing said impeller and having at least two holes defined therein so that said drive shaft can pass through the housing, an inlet formed in a central portion of said housing and through which ambient air is drawn into said chamber, and an outlet formed in a top portion of said housing and through which air is fed to said head and said cylinder.

2. An engine compressor as claimed in claim 1, wherein said housing comprises two parallel plates, a first of which is secured to said casing of said engine, and a second of which is secured to said casing of said compressor portion, said plates being integral with each other along bent lateral edges.

3. A engine compressor as claimed in claim 2, wherein said first plate has a circular bottom portion and a first through hole defined therein to receive said drive shaft.

4. An engine compressor as claimed in claim 3, wherein said second plate has a circular bottom portion and a second through hole defined therein through which said drive shaft passes through and which constitutes said inlet.

5. An engine compressor as claimed in claim 4, wherein both said plates have substantially rectangular top portions that extend upwards, and wherein said outlet is defined between top ends of said top portions.

6. An engine compressor as claimed in claim 5, wherein along the top end of said top portion of said second plate, and at said outlet, a number of slots are formed for increasing the size of said outlet and enabling cooling fins on said compressor portion to extend inside said chamber.

7. An engine compressor as claimed in claim 2, wherein between said second plate and said casing of said compressor portion, a predetermined clearance is defined for enabling the passage of ambient air to said inlet.

8. An engine compressor as claimed in claim 1, wherein between said housing and said casing of said engine there is provided a layer of insulating material.

9. An engine compressor as claimed in claim 1, wherein said casing of said compressor portion has a wall with a hole defined therein to receive a portion of a crankshaft which transmits power between said drive shaft and said connecting rod, said portion of said crankshaft being engaged internally by an end of said drive shaft, and wherein said crankshaft portion is held in position by a roller bearing which is positioned between the wall and the crankshaft portion.

* * * * *